US007131167B2

(12) United States Patent
Stagnaro

(10) Patent No.: US 7,131,167 B2
(45) Date of Patent: Nov. 7, 2006

(54) BELAY

(76) Inventor: Louis Stagnaro, 3355 Hawk St., San Diego, CA (US) 92103

( * ) Notice: Subject to any disclaimer, the term of this patent is extended or adjusted under 35 U.S.C. 154(b) by 91 days.

(21) Appl. No.: 11/030,410

(22) Filed: Jan. 6, 2005

(65) Prior Publication Data

US 2006/0143873 A1 Jul. 6, 2006

(51) Int. Cl.
*A45F 5/00* (2006.01)
*G02C 3/00* (2006.01)

(52) U.S. Cl. ..... 24/3.3; 24/3.1; 24/24; 24/3.13

(58) Field of Classification Search ..... 24/3.3, 24/3.13, 3.1
See application file for complete search history.

(56) References Cited

U.S. PATENT DOCUMENTS 4,958,758 A * 9/1990 Tipple et al. ..... 24/3.2
4,966,451 A * 10/1990 Corral et al. ..... 351/43
5,367,347 A * 11/1994 Wilson et al. ..... 24/3.3
5,600,873 A * 2/1997 May ..... 24/3.2
5,628,092 A * 5/1997 Harris et al. ..... 24/3.3
5,940,938 A * 8/1999 Davancens et al. ..... 24/3.3
6,098,250 A * 8/2000 Katz ..... 24/3.3

* cited by examiner

*Primary Examiner*—Robert J. Sandy
(74) *Attorney, Agent, or Firm*—Lisel M. Ferguson; Procopio, Cory, Hargreaves & Savitch LLP

(57) ABSTRACT

Neck leash device for retaining eyewear while the wearer is in the water. With a leash portion which contains a float for easy location of the eyewear if lost, a wrist band for secondary safety should the leash come over the wearer's head, a quick release on the wrist band should the leash become tangled with the wearer, a pocket to hold small valuables so they will not be lost and a clamp that attaches to each end of said leash at the strap and each arm of the eyewear. A preferred embodiment includes wherein said leash portion is made of an elastic cord, a float is connected at the bottom of the two straps connecting to the arms of the eyewear and the single extending leash. The leash extends beyond the float approximately four feet and ends in a neoprene wrist band having an interlocking male and female connector material, such as VELCRO with a pocket to hold valuables and a break free device.

13 Claims, 2 Drawing Sheets

BELAY

BACKGROUND OF THE INVENTION

1. Field of the Invention

This invention relates generally to neck leashes for retaining eyewear and holding valuables.

2. Description of Related Art

Conventional neck leashes typically hold eyewear onto the head while a person is on land. They are not adapted to be functional while the wearer is in the water. They do not have flotation devices, break free safety mechanisms or storage compartments. Consequently, water persons such as surfers, kayakers, paddle boarders and lifeguards cannot rely on conventional neck leashes to retain and save their eyewear. Conventional neck leashes, suffers from several drawbacks if used in the water. For example, the conventional neck leash will sink if dropped into the water and will most likely never be found. The conventional neck leash is further not designed to be secured to the wearer's hand as well as head allowing for extra security when in an aquatic environment.

Lastly, such a neck leash does not have a compartment to safely hold valuable items such as keys and credit cards while in the water.

The present invention has recognized these prior art drawbacks, and has provided the below-disclosed solutions to one or more of the prior art deficiencies.

BRIEF SUMMARY OF THE INVENTION

The instant invention relates to a neck leash for retaining eyewear. This invention is specialized to be functional when worn in the water by a sports oriented individual. The inventor envisions this neck leash being worn by surfers, paddle boarders, kayakers, lifeguards or other watermen. During these aquatic activities this neck leash not only functions to hold the glasses onto the wearer's head, but it additionally functions to hold their keys or other small items.

This neck leash has multiple safety mechanisms to insure that the glasses will not be lost. First, this leash contains a visible float so that if the neck leash comes free from the wearer it will float on the surface of the water and can be easily retrieved by the wearer. This float will cause the leash to wash into shore for easy recovery, if it is not retrieved sooner. Secondly, this leash connects to the wearer's arm with a wrist band having an interlocking male and female connector material, such as VELCRO. This connection contains a break free device should the wearer become tangled in the cord. Further, this wrist connection runs from the back of the wearer's head down his arm so that it is out of the way of arm movements. This cord can be run down the arm of a wet suit to contain it further.

In a presently preferred embodiment, it is the object of this invention to provide a neck leash to hold eyewear that will keep the eyewear from getting lost, and ensure the safety of the wearer through the break free devise. It is further an object of this invention to provide a storage area for small items such as keys, credit cards and insure that they are not lost in the water.

BRIEF DESCRIPTION OF THE SEVERAL VIEWS OF THE DRAWING(S)

The invention will be more fully understood by reference to the following drawings which are for illustrative purposes only:

DETAILED DESCRIPTION OF THE INVENTION

Referring more specifically to the drawings, for illustrative purposes the present invention is embodied in the apparatus generally shown in FIG. 1 through FIG. 4. It will be appreciated that the apparatus may vary as to configuration and as to details of the parts, without departing from the basic concepts as disclosed herein.

DESCRIPTION OF A PREFERRED EMBODIMENT OF THE PRESENT INVENTION

Figure 1:
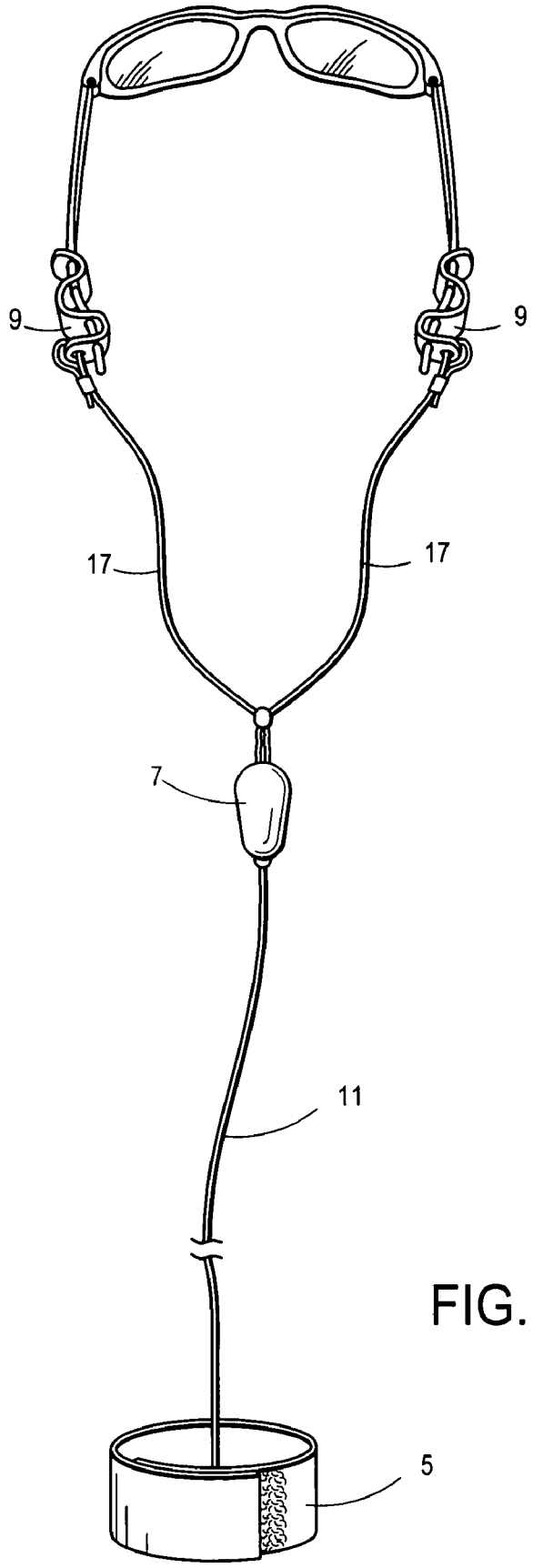
FIG. 1 is a full view of the belay neck leash attached to eyewear.
Figure 2:
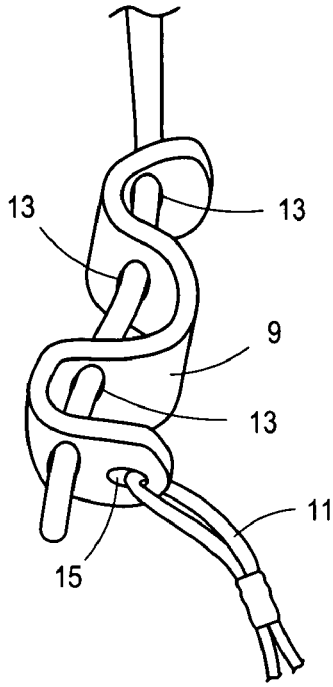
FIG. 2 is a expanded view of one of the clamps of the belay neck leash shown connecting the arms of the eyewear.
Figure 3:
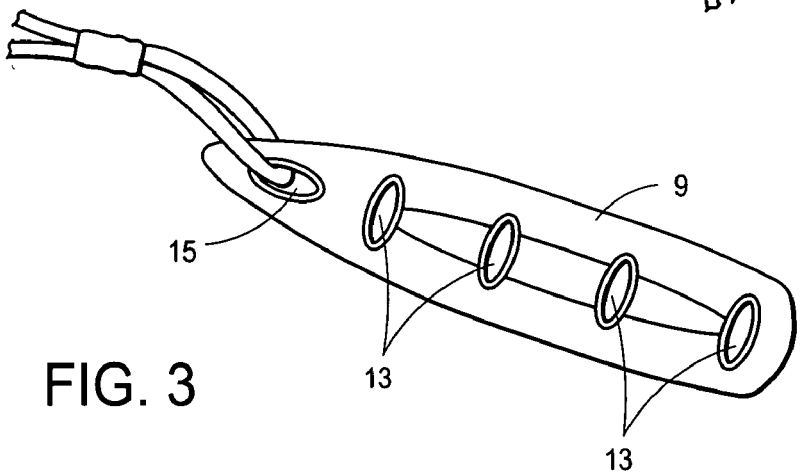
FIG. 3 is a close-up view of one of the clamps of the belay neck leash which connects to the arms of the eyewear.

Referring to FIGS. 1 though 4, an belay neck leash is shown and generally designated. FIGS. 1 through 4 show that the belay neck leash includes a preferably elastic leash portion, a neoprene wrist band, a float and plastic or clips made of an interlocking male and female connector material, such as VELCRO. Referring to FIG. 1, the leash portion (11) connects to the wristband and runs from the wrist band (5) to its connection with the float (7), a pair of straps (17) attach at one end to the float (7). The straps (17) connect at the other end to the clips (9). Each strap connects through a hole (15) in either clip (9). The clips (9) are made of a rubber or plastic material and contain holes (13) for the arms of the eyewear to thread through FIG. 2. Referring to FIGS. 2 and 3, preferably the clips (9) are made of a flexible material and contain multiple holes (13). The holes (13) stretch to accommodate to hold the arm of the eyewear tight. The clips hold the arms of the eyewear and connecting the eyewear to the leash.

Figure 4:
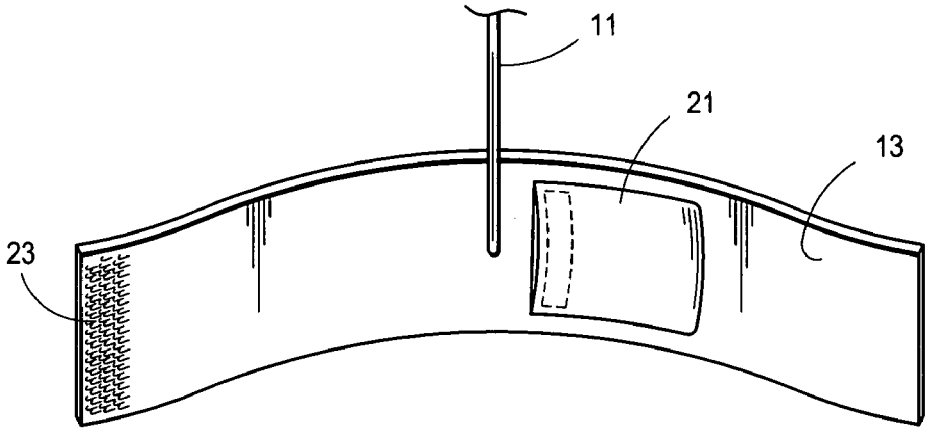
FIG. 4 is a view of the wrist band for the belay neck leash.

Referring specifically to FIG. 4, at the distal end the leash connects to a wrist band (5). The wristband is designed to be fastened with a interlocking male and female connector material, such as VELCRO (23) around the wearer's arm or leg. This wristband contains a pocket (21) which can be fastened shut with preferably a interlocking male and female connector material. This pocket is large enough to hold keys or credit cards.

Referring specifically to FIG. 1, the float (7) is made of a buoyant material which will sustain the weight of the leash assembly and the connected glasses. The float is preferably a bright color that can be seen from a distance so that it can be easily seen resting on the top of the water or lying on the shore for optimal recovery.

The belay is preferably used as a leash to retain eyewear when performing water sports. It is specifically designed to overcome all of the inadequacies of current eyewear leashes when used in an aquatic environment.

It will be understood that various modifications can be made to the embodiments of the present invention herein described without departing from the spirit thereof. The above description should not be construed as limiting the invention, but merely as exemplifications of preferred embodiments thereof. Those skilled in the art will envision other modifications within the scope and spirit of the present invention.

What is claimed is:

1. A neck leash device for retaining eyewear, comprising:

a wrist band portion;

at least one pocket on the wrist band;

a leash portion connected to the wrist band;

a floatation device connected to the leash portion;

a pair of straps connected on the distal end of the floatation device; and a pair of clamps each configured to couple to each side of eyewear.

2. The neck leash device of claim 1, wherein the wristband portion is constructed with a strip of neoprene covered in an interlocking male and female connector.

3. The neck leash device of claim 2, wherein one end of the wristband strap has a length of the male connector of the interlocking male and female connector material while the other end has a length of the female connector of the interlocking male and female connector material so that the two ends can be overlapped at various locations to form a loop around a wearer's arm.

4. The neck leash device of claim 2, wherein the wristband contains a pocket with an interlocking male and female connector closure to fasten it shut.

5. The neck leash device of claim 2, wherein the wristband contains a break free device.

6. The neck leash device of claim 1, wherein the leash portion ranges from 30 to 70 inches in length and is constructed out of an elastic material.

7. The neck leash device of claim 1, wherein the leash portion connects to the wristband at one end and the floatation device on the other end.

8. The neck leash of claim 1, wherein the pair of straps connect at one end to the floatation device and at the distal end of each strap connect to one of the clamps.

9. The neck leash of claim 1, wherein each of the two clamps connects singularly to each of two arms of eyewear.

10. The neck leash device of claim 1, wherein the floatation device has sufficient buoyancy to hold the neck leash and connected eyewear above water.

11. The neck leash device of claim 10, wherein each strap is 12 to 20 inches and is worn on either side of the wearer's head.

12. The neck leash device of claim 11, wherein each clamp is made of a rubber or other flexible material.

13. The neck leash device of claim 11, wherein each clamp contains four holes for fastening an arm of eyewear.

* * * * *